US005372067A

United States Patent [19]

Doyle, deceased

[11] Patent Number: 5,372,067

[45] Date of Patent: Dec. 13, 1994

[54] KEYLESS LITHOGRAPHY WITH SINGLE PRINTING FLUID

[75] Inventor: Frank J. Doyle, deceased, late of Downers Grove, Ill., by Patrica Doyle, legal representative

[73] Assignee: Rockwell International Corporation, El Segundo, Calif.

[21] Appl. No.: 105,486

[22] Filed: Aug. 11, 1993

Related U.S. Application Data

[63] Continuation of Ser. No. 693,116, Apr. 25, 1991, abandoned.

[51] Int. Cl.[5] ..... B41F 7/36

[52] U.S. Cl. ..... 101/148; 101/451; 101/350

[58] Field of Search ..... 101/450.1, 451, 452, 101/148, 350

[56] References Cited

U.S. PATENT DOCUMENTS

| | | | |
|---|---|---|---|
| 4,619,198 | 10/1986 | Moll | 101/148 |
| 4,864,925 | 9/1989 | Van Kanegan et al. | 101/451 X |
| 5,007,341 | 4/1991 | Nakano et al. | 101/148 |
| 5,012,737 | 5/1991 | Makino et al. | 101/148 X |
| 5,107,762 | 4/1992 | Fadner et al. | 101/451 |
| 5,113,761 | 5/1992 | Okamura | 101/350 |

FOREIGN PATENT DOCUMENTS

| | | | |
|---|---|---|---|
| 286449 | 3/1990 | Japan | 101/450.1 |

*Primary Examiner*—Edgar S. Burr
*Assistant Examiner*—Stephen R. Funk
*Attorney, Agent, or Firm*—C. B. Patti; H. F. Hamann

[57] ABSTRACT

Keyless lithographic printing system with single printing fluid. A lithographic printing press has a blanket cylinder (101) and a plate cylinder (102) with a printing plate (100) mounted thereon, a form roller system (103) having at least one form roller rotationally contacting the plate cylinder (102), a printing fluid supply system for supplying a controlled composition of printing fluid to the form roller system (103). A reservoir system (110, 124, 126, 107, 128) is provided for containing the printing fluid, the printing fluid being a predetermined composition of dampening water and ink. A pickup roller (106) removes the printing fluid from the reservoir system, the pickup roller (106) having an oleophilic and hydrophobic surface. A drum roller (104) transfers the printing fluid to the form roller system (103), the drum roller (104) having an oleophilic and hydrophobic surface and interfacing with the form roller system (103). A roller (105) forms a uniform thin film of printing fluid on the surface of the drum roller (104), the roller (105) for forming the uniform thin film being in rotational contact with the drum roller (104) and the pickup roller (106). A printing fluid removal device (108) is provided for removing at least a portion of printing fluid from at least one of the surface of the drum roller (104) and a surface of the at least one form roller in the form roller system (103).

16 Claims, 4 Drawing Sheets

KEYLESS LITHOGRAPHY WITH SINGLE PRINTING FLUID

This application is a continuation of application Ser. No. 07/693,116, filed Apr. 25, 1991, now abandoned.

BACKGROUND OF THE INVENTION

The present invention relates to a single-fluid lithographic printing process and to method and means for carrying out that process.

In the art and practice of high-speed lithographic offset printing, ink is more-or-less continuously conveyed from a suitable reservoir by means of a series of coextensive rollers to a planographic printing plate where the image portions of the printing plate accept ink from the last of the series of inking rollers. A portion of that ink is then transferred to a printing blanket as a reverse image from which a portion of the ink is transferred in the form of a right-reading image to paper or another suitable substrate. It is essential in conventional lithographic printing processes that dampening water containing proprietary additives also be conveyed more-or-less continuously to the printing plate where, by transferring in part to the non-image areas of the printing plate, the water operates to keep those non-image areas free of ink.

In conventional printing press systems, both the ink and the dampening water are continuously and separately made available to all parts of the printing plate, image and non-image areas alike: and in the absence of dampening water, the printing plate will accept ink in both the image and non-image areas of its surface.

Lithographic printing plate surfaces in the absence of imaging materials have minute interstices and an overall hydrophilic or water-loving character that enhance retention of water rather than ink in the non-imaged areas. Imaging this hydrophilic plate surface creates oleophilic areas according to the desired image format. Subsequently, when water is presented to the inked, imaged plate in appropriate amounts only that ink residing in non-image areas becomes debonded. In its simplest view, this action accounts for the continuous image and non-image differentiation at the printing plate surface which differentiation is essential and integral to the lithographic printing process.

Controlling for the correct amount of dampening water input during lithographic printing has been an industry-wide problem ever since the advent of lithography. Doing so requires continual operator attention since each change in ink input appears to require a change in dampener input. However, balancing the ink input across the width of the press with dampener input across the width of the press is at best a compromise. Consequently, depending upon which portion of the image format the operator has selected for complying to a standard print quality at any given time during the printing run, he may need to adjust the ink input at that cross-press position which inadvertently also changes the water balance at that position. Conversely, the operator may adjust the dampener input to balance one portion of the image. This action may affect the ink and water balance at one or more other cross-press locations. Adjustments of these types tend to occur repeatedly throughout the whole press run resulting in slight to major differences in the quality of the printed output throughout the run. In carrying out these adjustment operations, the resulting copies may or may not be commercially acceptable, leading to waste in manpower, materials, and printing machine time.

Means for correcting this inherent fault of conventional lithography have been addressed; none have achieved industry-wide success. These methods involve either eliminating the dampening system or they involve eliminating operator control of the dampening system.

Newspaper printing configurations are known which rely on the inking train of rollers to carry dampening water to the printing plate. Reasons why the ink-train-dampening system operates especially well without alcohol or similar dampener additives as traditionally specified for use with other existing ink-train-dampeners are not clear. Configurations such as those noted above will, together with appropriate ink and dampening concentrate selections, function such that the ink itself carries all of the required dampening water to the printing plate, yet the press functions and is controlled more-or-less conventionally from the viewpoint of lithographic printing. Accordingly, all of the conventional problems inherent in attaining and maintaining the optimum balance of ink and water input also attend this type of ink-train-dampening lithographic printing press system.

Planographic printing systems and elements thereof which do not require dampening water, and may therefore be termed single-fluid systems, are known in the prior art. Such systems rely in one way or another on low-surface-energy silicone non-image portions of the printing plate disallowing ink adhesion, thereby forming the basis for differentiation between ink-receptive nonsilicone image areas and of non-ink-receptive non-image silicone areas of the printing plate. Only ink needs to be available to the plate, dampening solutions being unnecessary. These single-fluid planographic printing systems enjoy limited commercial success because of higher plate cost and because the more-expensive printing plates have a relatively short useful lifetime on-press. In addition, the ink needs to be formulated to take into account that the press temperature varies during printing causing the ink transfer efficiency to change, necessitating more-or-less continual operator adjustment of inking keys. Thus, although no dampening fluid adjustments are necessary, cooling of press cylinders may be required, as well as considerable operator attention to compensate for gradual heat-induced inking changes which render these systems of limited commercial value. For these reasons usefulness of these systems has in practice been limited to short runs, generally of 50,000 copies or less.

SUMMARY OF THE INVENTION

A primary object of the present invention is to provide a simple, economical, single-fluid planographic printing system.

Another object is to provide printing fluid handling means for the practice of single-fluid lithography having long-lasting, low-cost components.

A further object of the present invention is to provide single-fluid printing metering means not requiring special celled metering rollers which operate with a coacting doctor blade.

Yet another object is to provide a single-fluid planographic printing press system method and means requiring minimal configurational differences from existing conventional bi-fluid printing means.

In a lithographic printing press having a blanket cylinder and a plate cylinder with a printing plate mounted thereon and a form roller system having at least one form roller rotationally contacting the plate cylinder, a printing fluid supply system for supplying a controlled composition of printing fluid to the form roller system comprises the following elements. A reservoir means contains the printing fluid, the printing fluid being a predetermined composition of dampening water and ink in which an oil-based ink is the continuous phase. In one variation a pickup roller means removes the printing fluid from the reservoir means, the pickup roller means having an oleophilic and hydrophobic surface. A drum roller means transfers the printing fluid to the form roller system, the drum roller means having an oleophilic and hydrophobic surface and interfacing with the form roller system. Alternately transfer roller means forms a uniform thin film of printing fluid on the surface of the drum roller means, the roller for forming the uniform thin film being in rotational contact with the drum roller means and the pickup roller means. A printing fluid removal means continuously removes at least a portion of the unused printing fluid from the return side surface of the drum roller means or from the return side surface of at least one form roller in the inking roller system.

In one embodiment the roller for forming the uniform thin film is a transfer roller in rotational contact with the drum roller means and the pickup roller means. Also, in one embodiment the printing fluid removal means contacts the surface of the drum roller means on a return side of the drum roller means and the printing fluid removed is returned to the reservoir means. In another embodiment the printing fluid removal means contacts the surface of at least one form roller in the form roller system on a return side thereof and the printing fluid removed is returned to the reservoir means.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENTS

Figure 1:
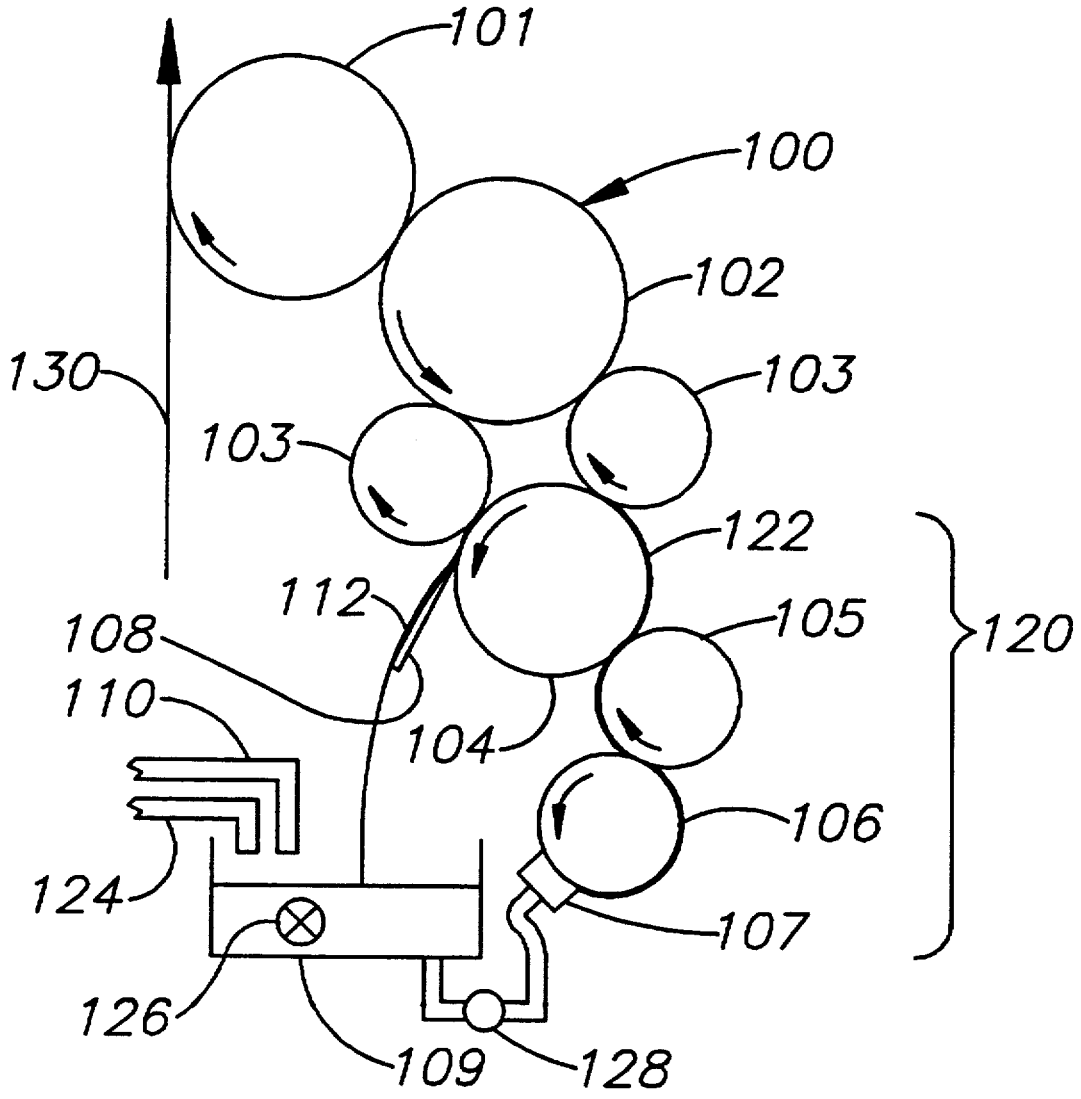
FIG. 1 is a schematic side view of a single-fluid planographic printing press according to the present invention.

This invention is based on a combination of elements differing from the prior art, which will become apparent by considering the accompanying figures.

Referring to FIGS. 1 through 4, a paper web 130 is printed by means of ink transfer from a conventional rubber blanket printing cylinder 101, which receives ink from a conventional planographic printing plate 100 mounted on a plate cylinder 102. The lithographic printing plate 100 mounted on cylinder 102 in turn receives the ink and the dampening water necessary to accomplish image differentiation at the plate surface from a printing fluid carried by one or more rotationally cooperating form rollers 103. The printing fluid consists of a mixture of dampening water and oil-based lithographic ink and is formulated so that the oily ink portion forms a substantially continuous medium with water admixed or dispersed therein. The printing fluid is controllably metered to the form rollers 103 by a suitable continuous input and output system 120 as herein described.

Now referring specifically to the embodiment depicted in FIG. 1, the roller system supply means 120 has a printing fluid input means 107, such as a press-wide or page-wide injector rail or similar pump-fed fluid distributor that applies by means of pump pressure and suitable orifices a more-or-less uniform film of printing fluid to oleophilic and hydrophobic pickup roller 106. Pickup roller 106 will normally be rotated slower than the press by a separate adjustable drive or braking means (not shown) and is mounted to be adjustable relative to rubber-covered transfer roller 105. The distributor orifice, pumping pressure, speed of roller 106 and center-to-center dimension between rollers 105 and 106 serve to define the amount of ink being continuously and uniformly conveyed by roller 105 to oleophilic and hydrophobic drum 104. These ink input principles and practices are well-known in the art of inking and may be practiced accordingly, excepting that in the present invention reasonably uniform cross-press or cross-page dampening fluid input rather than column-variable or keyed ink input is required.

Figure 2:
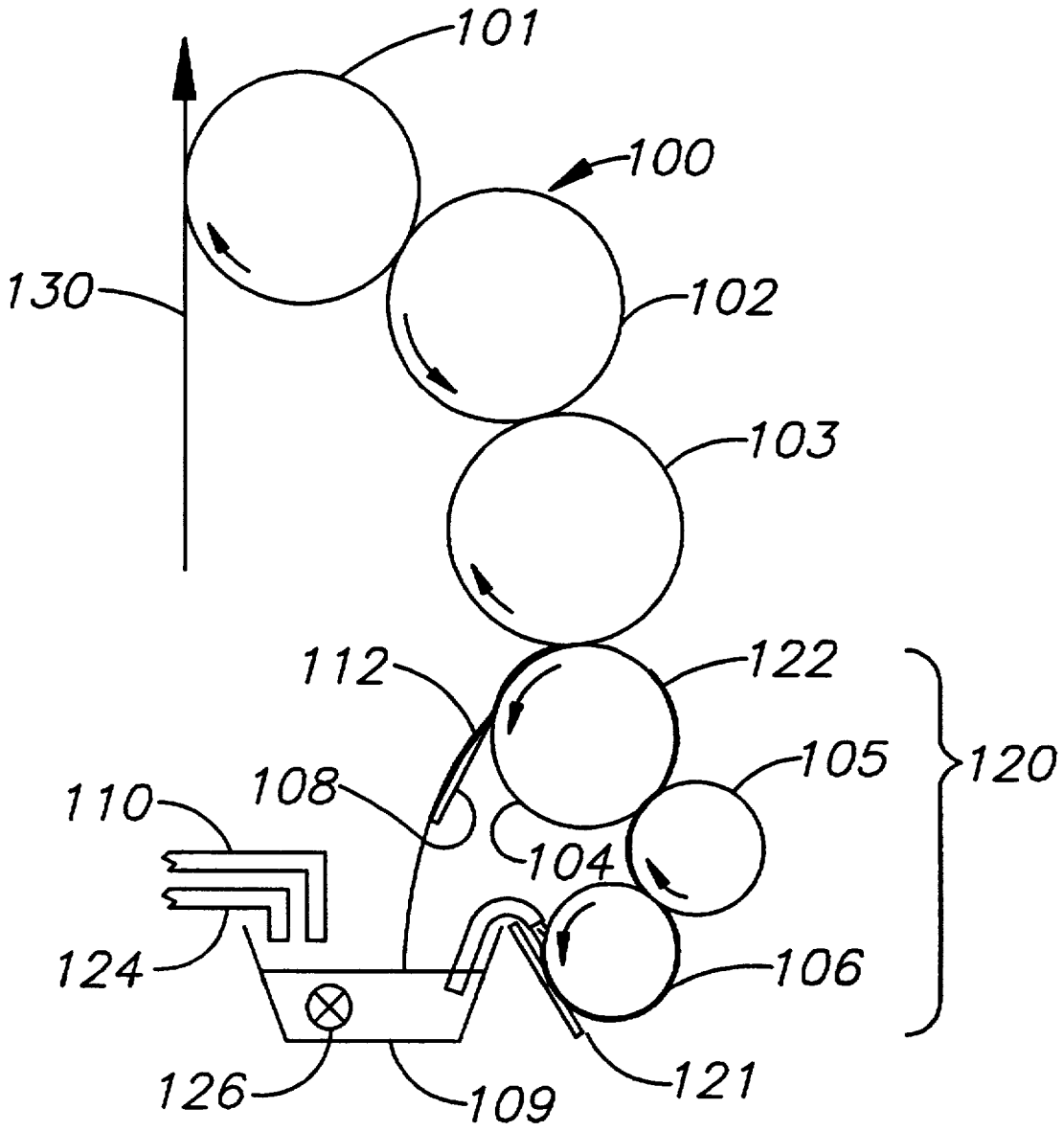
FIG. 2 is a schematic view of an alternative embodiment of the present invention having only one form roller.
Figure 3:
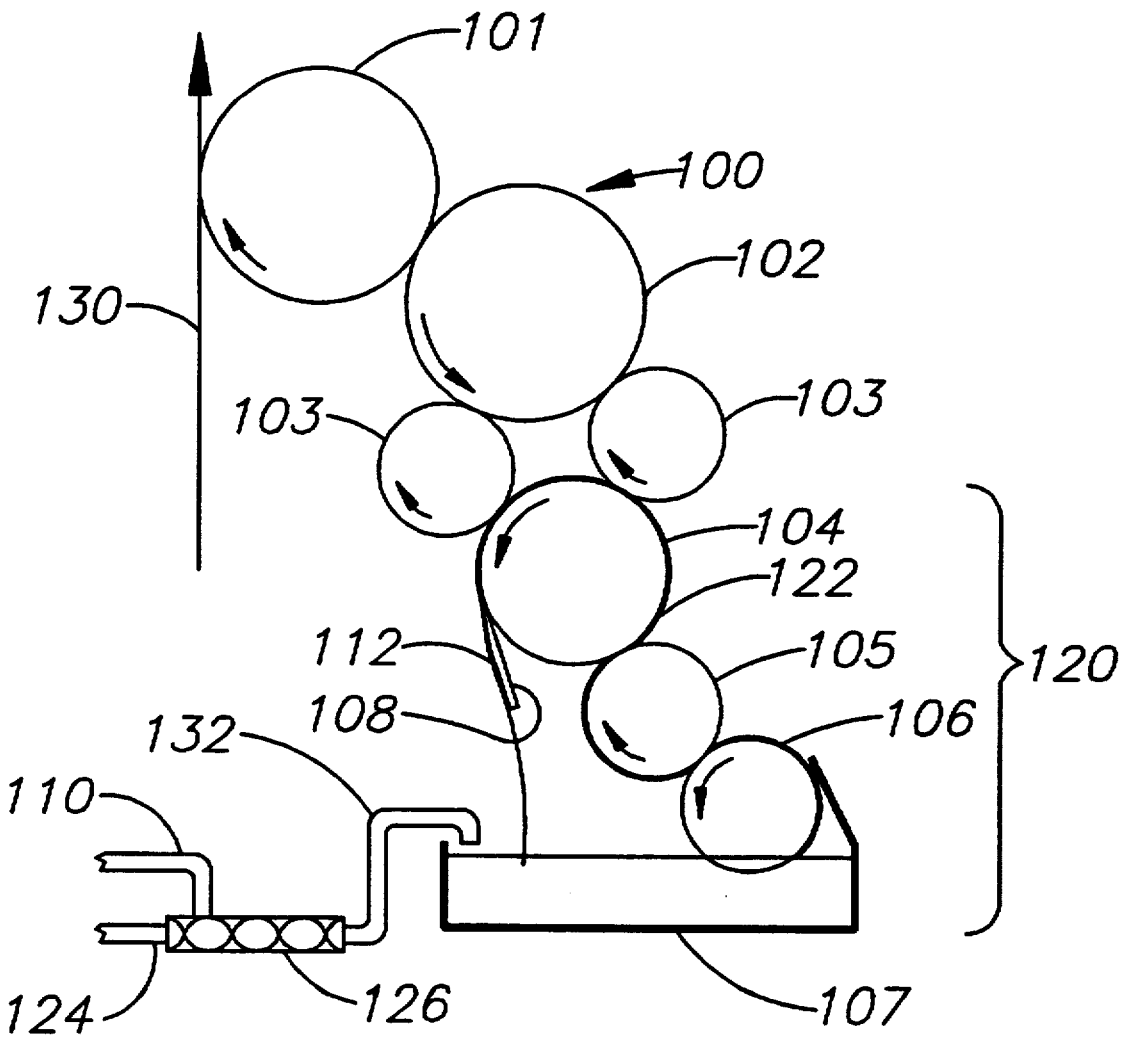
FIG. 3 is a schematic view of another alternative embodiment having an overshot ink input fountain.

In the FIG. 1 through 3 illustrations, drum 104 transfers printing fluid from transfer roller 105 to at least one form roller 103, thence to plate 100, to blanket printing cylinder 101 and to paper 130 as previously described. A portion of the printing fluid presented by drum 104 to form rollers 103 remains on drum 104 subsequent to the nip (nips) formed by rollers 103 and 104. This return-side printing fluid film 112 differs in composition from that of the metered input printing fluid 122. That composition depends upon the relative amounts of ink and dampening water that have been taken from the printing fluid by the image and non-image portions of the format being printed and occurs substantially at the nips formed by form rollers 103 and printing plate 100. Memory of that differing printing fluid composition is naturally conveyed by form rollers 103 back to drum 104 and towards doctor blade 108. Doctor blade 108 functions to continuously remove all or substantially all of the denatured printing fluid being conveyed away from the form rollers 103 by drum 104. The scraped-off denatured printing fluid is caught and led by means of suitable conduits to a continuous reconstituting system (such as elements 109, 110, 124 and 126 in FIG. 1) for reuse.

Typically, the reconstituting system will consist of ink reservoir 109, fresh ink input means 110, fresh dampening water input means 124 and mixer 126. Mixer 126 can be located, for instance, prior to the reservoir as depicted in FIG. 3 or in the reservoir as depicted in FIG. 1. Other combinations are obvious to those skilled in the art. The reconstituted printing fluid is then conveyed to the printing fluid input means 120, for instance, by pump and conduit 128.

FIG. 2 depicts an alternative embodiment that is similar to the FIG. 1 embodiment except for the use of a single form roller 103. It also illustrates advantageous use of a more-or-less conventional undershot printing fluid input fountain with an adjustable gap capability 121 between the fountain tip and rotationally speed adjustable pickup roller 106. Roller 106 functions as in FIG. 1 to help meter a more-or-less uniform film to transfer roller 105. Again columnar "inking" keys are avoided in construction of the printing fluid input components.

FIG. 3 illustrates a single printing fluid lithographic printing press system similar to that shown in FIG. 1, but featuring a typical overshot printing fluid input fountain means 132 of introducing a page-wide or press-wide metered film of printing fluid to pickup roller 105.

Figure 4:
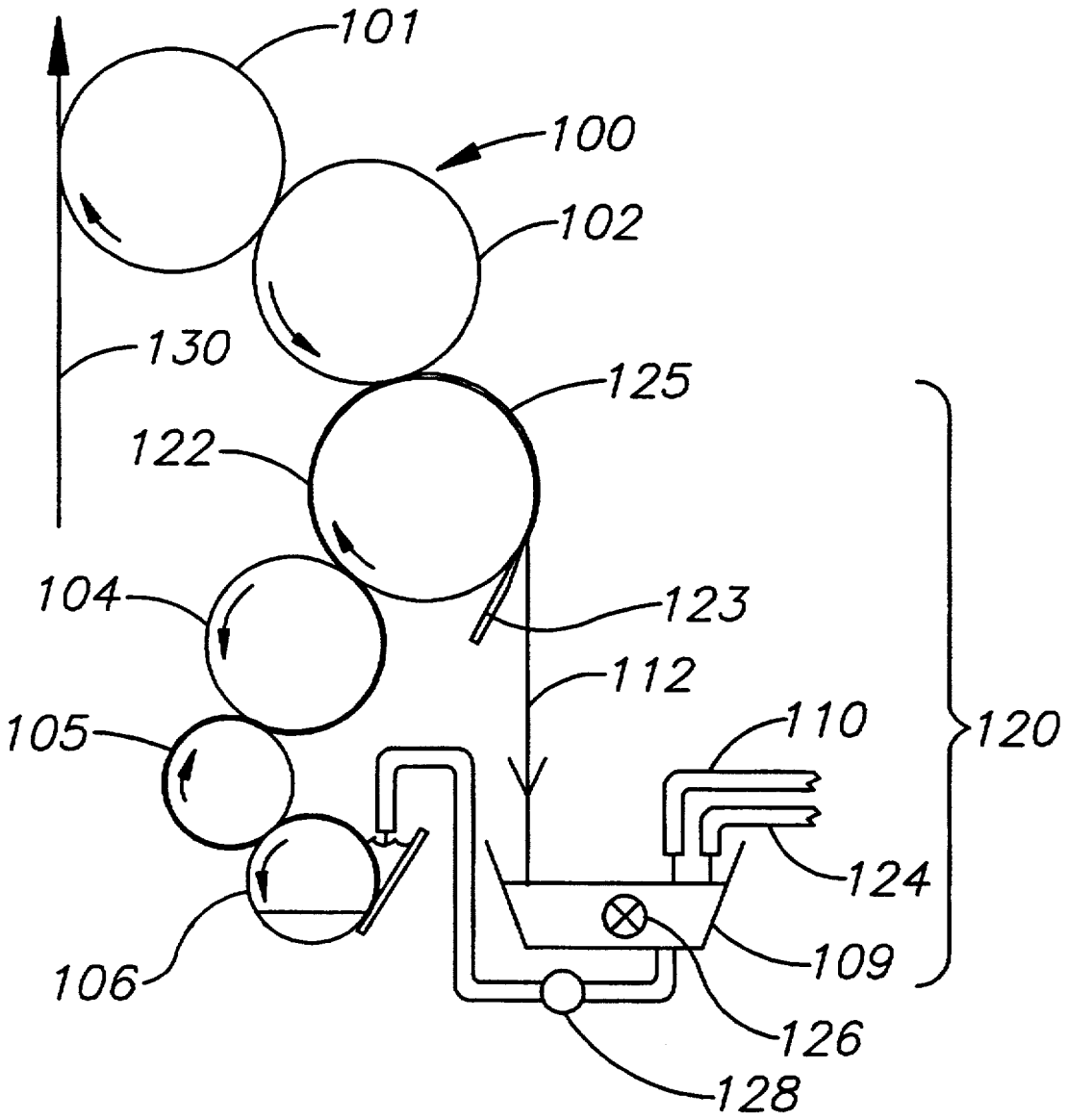
FIG. 4 is a schematic view of yet another embodiment in which a return film scraping blade rides against the form roller.

In FIG. 4 another embodiment is shown wherein a scraping or rubbing blade 123 functions to remove substantially all of the return, unused and denatured printing fluid from a single form roller 125, thereby preventing any printing fluid film memory from being transferred from the printing plate back to any of the other rollers of the inking train and hence back up to the printing plate and to the substrate being printed.

In the present invention, it is not necessary that all of the unused printing fluid returning from the printing plate by means of the form rollers be removed by the scraping blade that operates against the oleophilic and hydrophobic drum or roller specified herein. It is sufficient to remove most of that film, say 50% to 75% of it, because the remainder is essentially inoperative as printing fluid material, never being transferred ahead or back within the inking train. Since only the uppermost or active portion of the return film needs to be removed, the efficiency of scraping the drum to accomplish this removal need not be high. This allows use of less efficient scraping materials and methods than commonly employed in the art of printing fluid metering device operations. Relatively thick doctoring blades and normally inefficient plastic doctor blades may be employed to help reduce wear of the drum roller over that expected by using typical steel doctor blades riding on relatively soft copper roller surfaces.

The fact that not all of the return printing fluid needs to be removed for the practice of the present invention allows placing the return film scraping means 123 in contact with the relatively soft form roller 125 of, for instance, the single-form-roller printing press configuration of FIG. 4. Sufficient indentation of the form roller 125 by the blade 123 to interfere with and therefore remove substantial portions of the return film will suffice.

Preferably, a noncelled hardened and therefore wear-resistant oleophilic and hydrophobic drum may be employed in the scraping position.

Alternately the scraped noncelled drum roller of the present invention can be formed using a coating of RILSAN TM (C), which is a carbon-filled nylon composite, or other relatively wear-resistant polymeric hydrophobic and oleophilic material.

Successful operation of the present invention requires that the water content of the input printing fluid remain within a few percent of a predetermined value. The predetermined value or setpoint is affected by a complex combination of press conditions, including roller settings and press speed, by the specific dampening water and ink formulations that are employed and by ambient temperature and humidity conditions. However, once acceptable printing conditions are established or specified, for instance by trial and error, continued acceptable printing can be assured by including appropriate control elements for subsequent automatic printing fluid makeup and control.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. In a lithographic printing press having a blanket cylinder, a plate cylinder with a printing plate mounted thereon and a form roller system having at least one form roller for rotational contact with the plate cylinder, the improvement being a printing fluid supply system, comprising:

a reservoir containing printing fluid composed of a predetermined composition of dampening water and ink, said reservoir being the only supply of dampening water for the plate cylinder;

a pickup roller for removing said printing fluid from said reservoir, said pickup roller having an oleophilic and hydrophobic surface;

a wear resistant noncelled drum roller having an oleophilic and hydrophobic surface in rolling contact with the form roller system for transferring the printing fluid to the form roller system; and means for forming a uniform thin film of printing fluid on said surface of said wear resistant noncelled drum roller including a transfer roller in rotational contact with both said drum roller and said pickup roller.

2. The printing fluid supply system of claim 1 including means for removing at least a portion of the printing fluid from the surface of the drum roller.

3. The printing fluid supply system according to claim 2, wherein said printing fluid removal means contacts said surface of said drum roller on a return side of said drum roller and wherein the printing fluid removed is returned to said reservoir.

4. The printing fluid supply system of claim 3 in which the printing fluid removal means on the return side of the drum roller is the only printing fluid removal means in contact with the drum roller which returns the printing fluid to the reservoir.

5. The printing fluid supply system of claim 2 in which the printing fluid removal means includes a single scraping blade in contact with a return side surface of the drum roller and in which the single scraping blade is the only means for removing the printing fluid from the drum roller and returns the printing fluid to the reservoir.

6. In a lithographic printing press having a blanket cylinder, a plate cylinder with a printing plate mounted thereon and a form roller system having at least one form roller for rotational contact with the plate cylinder, the improvement being a printing fluid supply system, comprising:

a reservoir containing printing fluid composed of a predetermined composition of dampening water and ink, said reservoir being the only supply of dampening water for the plate cylinder;

a wear resistant noncelled drum roller having an oleophilic and hydrophobic surface in rolling contact with the form roller system for transferring the printing fluid to the form roller system; and means for removing at least a portion of the printing fluid from said surface of said drum roller, said printing fluid removal means including a member contacting said surface of said drum roller only on a return side of said drum roller and said contacting member being the only means for removing the printing fluid from the drum roller and returning the printing fluid to said reservoir.

7. The printing fluid supply system of claim 6 including means for removing the printing fluid from the reservoir including a pickup roller with an oleophilic and hydrophobic surface.

8. The printing fluid supply system of claim 7 including means for forming a uniform thin film of printing fluid on the surface of the drum roller including a transfer roller in rotational contact with both the drum roller and the pickup roller.

9. The printing fluid supply system of claim 8 in which the member includes a single scraping blade in contact with the return side of the drum roller.

10. In a lithographic printing press having a blanket cylinder and a plate cylinder with a printing plate mounted thereon, the improvement being a printing fluid supply system, comprising:

a reservoir containing printing fluid of a predetermined composition of dampening water and ink, said reservoir being the only supply of dampening water for the plate cylinder;

a form roller system having at least one form roller for rotational contact with the plate cylinder;

a drum roller having an oleophilic and hydrophobic surface in rolling contact with the form roller system for transferring the printed fluid to the form roller system;

means for transferring a uniform thin film of the printing fluid from the reservoir to the drum roller; and means for removing at least a portion of the printing fluid from a surface of said at least one form roller in said form roller system, said printing fluid removal means contacting a surface of said at least one form roller in said form roller system on a return side thereof and the printing fluid removed being returned to said reservoir.

11. The printing fluid supply system of claim 10 in which the printing fluid removal means includes a single scraping blade in contact with the return side of the form roller and being the only means for removing the printing fluid from the form roller which returns the printing fluid to the reservoir.

12. The printing fluid supply system of claim 11 in which the printing fluid transferring means includes means for removing the printing fluid from the reservoir including a pickup roller with an oleophilic and hydrophobic surface.

13. The printing fluid supply system of claim 12 in which the printing fluid transferring means further includes means for forming the uniform thin film of printing fluid on the surface of the drum roller including a transfer roller in rotational contact with both the drum roller and the pickup roller.

14. In a lithographic printing press having a blanket cylinder, a plate cylinder with a printing plate mounted thereon and a form roller system having at least one form roller for rotational contact with the plate cylinder, the improvement being a printing fluid supply system, comprising:

a reservoir containing printing fluid composed of a predetermined composition of dampening water and ink, said reservoir being the only supply of dampening water for the plate cylinder;

a pickup roller for removing said printing fluid from said reservoir, said pickup roller having an oleophilic and hydrophobic surface;

a drum roller having an oleophilic and hydrophobic surface in rolling contact with the form roller system for transferring the printing fluid to the form roller system;

means for forming a uniform thin film of printing fluid on said surface of said drum roller including a transfer roller in rotational contact with both said drum roller and said pickup roller; and means for removing at least a portion of the printing fluid from a surface of the at least one form roller in the form roller system.

15. The printing fluid supply system according to claim 14, wherein said printing fluid removal means contacts said surface of the at least one form roller in said form roller system on a return side thereof and wherein the printing fluid removed is returned to said reservoir.

16. The printing fluid supply system of claim 14 in which the printing fluid removal means includes a single scraping blade in contact with a return side surface of the at least one form roller and being the only means for removing the printing fluid from the form roller which returns the printing fluid to the reservoir.

* * * * *